United States Patent [19]

Haugaard et al.

[11] Patent Number: 4,791,771

[45] Date of Patent: Dec. 20, 1988

[54] WINDOW MEMBER

[75] Inventors: Kristian Haugaard, Gelsted; Knud E. Nissen, Hornsyld, both of Denmark

[73] Assignee: V. Kann Rasmussen Industri A/S, Soborg, Denmark

[21] Appl. No.: 67,483

[22] Filed: Jun. 29, 1987

[30] Foreign Application Priority Data

Jul. 3, 1986 [DK] Denmark ..... 3165/86

[51] Int. Cl.[4] ..... E04C 2/38

[52] U.S. Cl. ..... 52/656; 52/727; 49/DIG. 2

[58] Field of Search ..... 52/656, 208, 309.4, 52/309.9, 309.15, 204, 727, 728; 49/DIG. 1, DIG. 2

[56] References Cited

U.S. PATENT DOCUMENTS

| | | | |
|---|---|---|---|
| 1,587,012 | 3/1881 | Waterhouse | 52/309.4 |
| 2,767,443 | 10/1956 | Hobein et al. | 52/656 X |
| 2,917,788 | 12/1959 | Kunkel | 49/DIG. 2 |
| 4,642,955 | 2/1987 | Webb | 49/DIG. 2 X |

FOREIGN PATENT DOCUMENTS

| | | | |
|---|---|---|---|
| 8707182 | 2/1984 | Australia . | |
| 1119503 | 9/1965 | Fed. Rep. of Germany . | |
| 1159190 | 7/1971 | Fed. Rep. of Germany | 49/DIG. 2 |
| 2109749 | 9/1972 | Fed. Rep. of Germany . | |
| 2908926 | 4/1980 | Fed. Rep. of Germany . | |
| 2941012 | 4/1981 | Fed. Rep. of Germany . | |
| 35612 | 11/1960 | Finland | 49/DIG. 2 |
| 61548 | 3/1982 | Finland . | |
| 68696 | 2/1985 | Finland . | |
| 2402760 | 5/1979 | France | 52/208 |
| 123907 | 1/1972 | Norway . | |
| 564674 | 7/1975 | Switzerland . | |
| 890513 | 2/1962 | United Kingdom . | |
| 1212390 | 11/1970 | United Kingdom . | |

*Primary Examiner*—David A. Scherbel
*Assistant Examiner*—Creighton Smith
*Attorney, Agent, or Firm*—Lane & Aitken

[57] ABSTRACT

In a frame-shaped window member (1 or 2) including a framed core (10) made from wood material and provided with a covering (11) moulded thereon, preferably polyurethane, and supporting on its side facing the open air a weather-resisting shield (12), the part (11') of the covering facing the inside air has a far larger thickness and thus a corresponding minor permeability to vapor than the adjacent covering parts (11'') which fully or partly cover the remainder of the surface of the core.

12 Claims, 1 Drawing Sheet

WINDOW MEMBER

Figure 2:
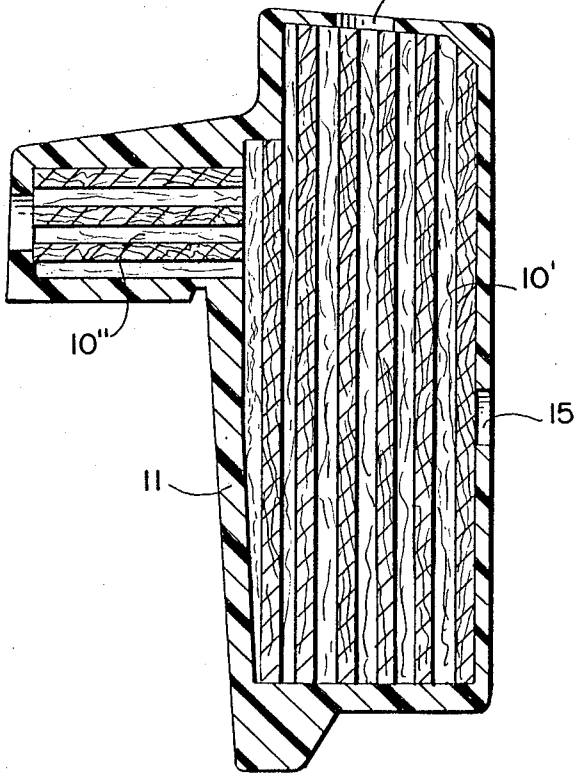

Window members in the form of complete window frames and sashes or window main frames as well as sectional members therefor, are traditionally manufactured from wood or metal and are according to requirement made weather resistent by painting or other surface treatment and may be further protected by externally mounted flashings, e.g. a shield of zinc, aluminium or plastic material. In case the members are made from metal they may generally be expected to possess a good weather resistance, but at the same time such frames form a cold-conducting bridge which frequently cannot be tolerated. On the contrary, wooden members are able to offer, even without special precautions, a sufficient resistance against undesired heat conduction, but in return more or less frequent painting is required in order to preserve weather resistance.

During recent years numerous proposals have been made to overcome the above mentioned dilemma, viz. by using suitable plastics materials.

It is thus known to mould complete frames from plastics material with a possibly necessary reinforcement of glass fibers or the like, but frames of this type are disproportionately expensive as to costs of materials and have, moreover, frequently a considerably heavier weight than traditionally manufactured frames.

DE-C-1,119,503 discloses a method of manufacturing inter alia window frames and main frames, providing for obtaining a saving of materials as well as a reduction of weight, namely by making up the frame of a core of wood or a wooden fiber material which in a casting mould has been embedded in a plastics material. Prior to or during the embedding the wooden core may be localized in the mould by means of hardened plastic drops securely fastened in the core and which are partly dissolved or softened by the moulding material.

Frame-shaped window members of the same kind, i.e. consisting of a core of wood embedded in plastics material are also known from DE-A-2,047,299 stating foamed polyurethane as a preferred plastics material, NO-C-123,907 stating however metal as the preferred material, GB-C-1,212,390 disclosing moulding of a window frame around the edge of a pane, and in which the frame includes a core of heat insulating material (illustrated as wood) with an encapsulation of sheet glass fibers impregnated by the moulded plastics material of the frame, the plastics material being for instance polyester, and AU-A-82,87071 indicating as the core material planks or pieces of wood, preferably dried to a moisture content in the range of not more than 8 to 9% and which may be cut from inexpensive, soft wood sorts like pine, but may at the same time include a hardwood edge strip not covered by the plastics material, e.g. PUR, which pieces may subsequently be planed down, particularly if the member is a door or a table top.

On the background of the outlined prior art the invention relates to a window member consisting of a core made from wood or from wood-based material and a covering of a preferably foamed plastics material, such as polyurethane (PUR), moulded thereon, and the member according to the invention differs from prior structures of the same kind in that, on one hand, it is adapted to support on its side facing the open air a shield protecting against weather, said shield defining together with the member an internal space ventilated by the outside air and, on the other hand, in that the covering is adapted so as to offer a high degree of impermeability to vapour solely on the surfaces of the member facing the inside air.

It has been ascertained by practical experiments that cores of solid pine and chipboard may be embedded in PUR without causing fractures in the PUR-layer or failing adhesion between it and the core—even without preceding drying of the core material and even after extreme moistening thereof—but it has also been ascertained that completed frames (having a weight of about 5 kg) including cores of such a material by repeated submersion into water and drying in a drying cupboard absorb water so as to increase their weight by about 1 kg, thereby causing the cores to swell so as to induce cracks in the PUR-layer.

Such a strong moistening of the core of the window member will obviously not or only as a pure exception occur in installed windows, but in spite of an apparently intact plastic covering, moisture will generally permeate in the form of vapour from the room or inside air due to its comparatively high moisture content. Particularly, under winter conditions, the penetrating moisture will condense within the core, thereby giving rise to so much accumulation of moisture therein that the core material decomposes by rot and fungus attack, in particular when said material for economical reasons is of a poor quality, such as waste timber or chipboard. The consequences of such a decomposition of the core may be eliminated by increasing the thickness of the plastic coating which then per se applies sufficient strength and rigidity to the window member, but if so, the additional consumption of the comparatively expensive covering material will entail uncompetitive manufacturing costs.

These circumstances are supposed to be the reason why plastic coated window members in spite of many proposals for their structuring have not been able to play a prominent role on the market.

In the invention, as specified above, the fact is recognized that a certain penetration of moisture into the core from the internal side of the window must be regarded as inevitable, caused inter alia by leaks in the covering originating from fixtures fastened by screws, but by the characteristic measures as mentioned the penetrating moisture is prevented in a simple and inexpensive manner from remaining as a condensate in the core material, since the moisture so to say escapes more easily to the outside air than it permeates from the inside air. This being so, even core material of a poor quality will be able to preserve its strengh so that the plastic covering shall not or only immaterially contribute to the rigidity of the completed member and, therefore, the plastic covering needs solely to be adapted or dimensioned according to the desired barrier effect against the inside air. This opens up the possibility of a considerable saving of material in comparison with the above recited, prior proposals.

In practice, the intended keeping dry the core may appropriately be ensured in that the covering is substantially thicker on the inward facing surfaces of the member than on the outward facing surfaces, and it may preferably be fully omitted on those parts thereof that are covered by the shield. This provides for minimizing the consumption of plastics material.

As already mentioned, different inexpensive wood-based materials may be used for the core of the member, but the core consists, however, preferably of one or more pieces cut from plywood, preferably so-called Douglas-plates, and constituting together a dominating portion, preferably not less than 75% of the total cross-sectional area of the frame member, and in which at least the major portion of the veneer layers is oriented substantially perpendicular to the plane of the window.

Experiments as those outlined above proved in this case a strongly reduced absorption of water, i.e. only in the range of 200 g, and almost no swelling of the core. The reason for this has not been unambiguously established, but a supposition that the adhesive layers between the laminated plywood sheets would cause a barrier effect against water vapour diffusion through the core material was not confirmed. On the contrary, it seems likely that due to the high pressure practiced in the production of plywood the adhesive has an impregnating effect on the laminate entailing that the wooden layers become less hygroscopic than in the natural state.

By way of the experiments referred to it may be regarded as established that despite application of materials on the same price level as spent on known windows of the same type, the member according to the invention is superior thereto with respect to durability not only when subjected to the conditions of experiment but also under normal climatic conditions on the site of installation.

The invention is illustrated by two embodiments on the drawings, in which

Figure 1:
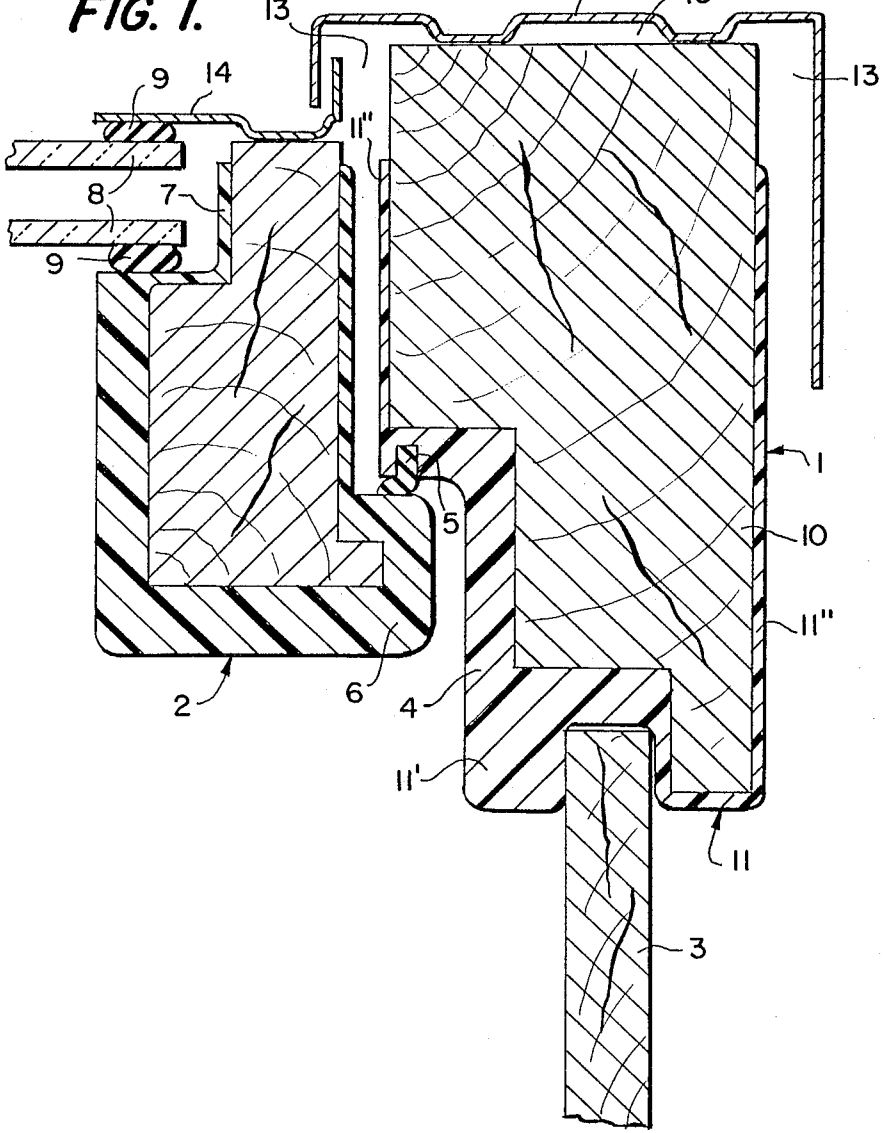

FIG. 1 illustrates a cross-section of a part of an openable window of which the main frame and the frame of which are made in accordance with the invention, and FIG. 2 is a cross-section of a frame or main frame section of a second embodiment.

In FIG. 1 the main frame of the window is generally designated 1 and the frame is designated 2. The hinge connection between said window sections and the remaining fixtures is indifferent to the invention and is therefore not shown.

The main frame as well as the frame have an ordinary cross-sectional shape, the main frame comprising an inside slot adapted to receive the edge of a connecting panel 3 and a recess 4 provided with a resilient gasket 5 to cooperate with an arresting projection 6 on the frame, said latter including an external recess 7 to receive a twin pane 8 supported between two gaskets 9.

The main frame 1 consists substantially of a core 10 made from wood or wood-based material of a poor quality, e.g. waste timber or chipboard. The core may in itself be frame-shaped, being for instance composed of four frame sections (of which only one is illustrated in the drawing) having rigid sash joints, and part of it is covered by a covering 11 of polyurethane moulded thereon and forming a smooth surface. As it will appear, the part 11' of the covering constituting the surfaces of the the main frame section facing the room air, i.e. from the panel 3 to the gasket 5, has a considerable thickness, whereas the thickness of the adjacent covering parts 11'' exposed to the open air only constitutes a fraction thereof. Said thinner covering parts may entirely cover the remainder of the cross-sectional periphery, but in the illustrated embodiment the outward facing portion of the core 10 is not at all covered. Said portion carries a shield 12 known per se and adapted to protect against weather, and between the shield and the main frame section an internal space 13 is provided to which the outside air has access for the purpose of ventilation as explained above.

The frame 2 of the window is formed quite analogously and its external shield 14 likewise serving to keep the twin pane 8 in place creates in the closing position of the window a labyrinthic sealing with the shield 12 of the main frame.

The main frame member or frame member illustrated in FIG. 2 includes a core composed of two plywood pieces 10' and 10'', preferably cut from Douglas-plates and which may be securely connected with each other and provided, at their ends, with corresponding members in adjacent frame sides. For the sake of clarity only every second wooden layer of the plywood members is marked by hatching and it will appear that the veneer layers of the dominating piece 10' are oriented perpendicularly to the plane of the window. The total cross-section of the pieces 10' and 10'' corresponds roughly, as regards the contour, to the cross-section of the member concerned of the completed frame and should, as regards area, constitute 85 to 90% or more thereof.

A covering 11 of polyurethane is moulded around the core. This has been effected in a known manner by means of a mould in which the framed core or core pieces are correctly localized prior to injection of the PUR-material which in this case entirely encloses the cross-section of the core but, as illustrated, may, however, have suitable ventholes 15 in the outward facing parts.

We claim:

1. A window frame member comprising a core made from wood or a wood-based material and having an external side intended to face outside air and an internal side intended to face inside air, and a covering of a plastics material molded on the core, wherein the improvement comprises the arrangement on the external side of the frame member of a weather protective shield defining together with the frame member an internal space ventilated by the outside air and the application of the covering to the core so as to offer a high degree of impermeability to vapor solely on the internal side of the member.

2. A window frame member as claimed in claim 1, wherein the covering is substantially thicker on the internal side of the member than on the external side.

3. A window frame member as claimed in claim 1, wherein the core comprises one or more pieces cut from plywood defining veneer layers and constituting in total a dominating portion of the total cross-sectional area of the frame member, at least the major portion of the veneer layers being oriented substantially perpendicular to the plane of the window.

4. A window frame member as claimed in claim 1, wherein the covering is made of a foamed plastics material.

5. A window frame member as claimed in claim 1, wherein said foamed plastics material comprises polyurethane.

6. A window frame member as claimed in claim 2, wherein the covering is omitted on the surface parts of the core facing the outside air.

7. A window frame member as claimed in claim 3, wherein the core comprises pieces of Douglas plates.

8. A window frame member as claimed in claim 3, wherein said dominating portion constitutes at least 75% of the total cross-sectional area of the frame member.

9. In a window frame member having a core of a wood-based material, an external surface exposed to outside air, an internal surface exposed to inside air, and a covering of plastics material on the core, the improvement comprising:

a weather protective shield spaced from said external surface, said shield defining with said external surface a space ventilated by the outside air, and said covering being more impermeable to vapor on said internal surface than on said external surface.

10. The window frame member of claim 9, wherein said covering is substantially thicker on said internal surface than on said external surface.

11. The window frame member of claim 9, wherein said covering covers only said internal surface.

12. A window frame including a plurality of window frame members and defining a plane, wherein each window frame member comprises:

a core of wood-based material;

an external surface exposed to outside air;

an internal surface exposed to inside air;

a covering of plastics material on the core;

a weather protective shield spaced from said external surface, said shield defining with said external surface a space ventilated by the outside air;

wherein said covering is more impermeable to vapor on said internal surface than on said external surface, and said core comprises at least one piece of plywood defining layers and constituting a dominating portion of the cross-sectional area of said frame member, at least the major portion of the layers being oriented substantially perpendicular to the plane defined by the window frame.

* * * * *